US005775134A

United States Patent [19]

Otobe et al.

[11] Patent Number: 5,775,134

[45] Date of Patent: Jul. 7, 1998

[54] PATTERNING UNIT OF WARP KNITTING MACHINE AND CONTROL METHOD THEREOF

[75] Inventors: Yoshinori Otobe; Yasumasa Narikiyo; Shigeo Yamagata; Norimasa Nosaka, all of Fukui, Japan

[73] Assignee: Nippon Mayer Co., Ltd., Fukui, Japan

[21] Appl. No.: 716,215

[22] PCT Filed: Jan. 18, 1996

[86] PCT No.: PCT/JP96/00075

§ 371 Date: Nov. 6, 1996

§ 102(e) Date: Nov. 6, 1996

[87] PCT Pub. No.: WO96/22412

PCT Pub. Date: Jul. 25, 1996

[30] Foreign Application Priority Data

Jan. 19, 1995 [JP] Japan ..... 7-006224

[51] Int. Cl.[6] ..... D04B 27/26

[52] U.S. Cl. ..... 66/204; 66/207

[58] Field of Search ..... 66/204, 207; 318/135

[56] References Cited

U.S. PATENT DOCUMENTS

| | | | |
|---|---|---|---|
| 4,876,862 | 10/1989 | Zorini | 66/207 |
| 5,307,648 | 5/1994 | Forkert et al. | 66/207 |
| 5,311,752 | 5/1994 | Gille | 66/207 |
| 5,331,828 | 7/1994 | Weis et al. | 66/204 |
| 5,353,611 | 10/1994 | Wade et al. | 66/207 |
| 5,390,513 | 2/1995 | Hagel et al. | 66/204 X |
| 5,473,913 | 12/1995 | Bogucki-Land | 66/204 X |
| 5,553,470 | 9/1996 | Hohne et al. | 66/204 X |

*Primary Examiner*—John J. Calvert

*Attorney, Agent, or Firm*—Jordan and Hamburg

[57] ABSTRACT

The present invention provides a patterning unit of a warp knitting machine in which a stator of a linear pulse motor is assembled in a holding member and a plurality of moving elements are provided at arbitrary intervals on the same holding member with part of the moving element being constructed as a guide point. The construction allows a thin linear pulse motor to be realized, erroneous operation such as step-out to be prevented in positioning control and the positioning to be carried out stably regardless of power failure or external noise. To that end, poles of the moving element are disposed so as to face poles on both sides of the stator. Moving element driving coils of the poles of the moving elements, NS directions of two field magnets and teeth of the poles of the stator are set so that a magnetic path of the field magnets runs in the same direction. A control method increases reliability of accuracy of positioning of the moving element and eliminates erroneous operation such as step-out by providing a position sensor in connection with the poles and by controlling the exciting condition by a set of parameters. Signal cables connected to the moving elements are removed to enlarge a range of the moving element. A microcomputer is mounted on the moving element to reduce an amount of information to be provided by induction lines.

16 Claims, 15 Drawing Sheets

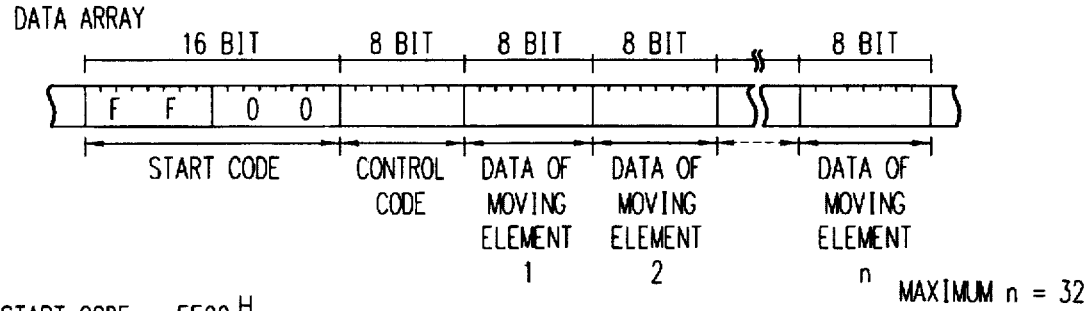

START CODE FF00$^H$

CONTROL CODE

00$^H$ STOPPED STATE

01$^H$ START UNDERLAP POSITIONING

02$^H$ START OVERLAP POSITIONING

03$^H$ START POSITIONING OF RETURN

04$^H$ START ADJUSTMENT OF SPAN

05$^H$ TRANSMIT COMMAND VALUE
(EXIST DATA OF MOVING ELEMENTS 1 THROUGH n)

06$^H$ TRANSMIT RETURN COMMAND VALUE
(EXIST DATA OF MOVING ELEMENTS 1 THROUGH n)

07$^H$ TRANSMIT CORRECTION VALUE
(EXIST DATA OF MOVING ELEMENTS 1 THROUGH n)

08$^H$ TRANSMIT CONTROL DATA
(EXIST DATA OF MOVING ELEMENTS 1 THROUGH n)

09$^H$ NON-USED

0F$^H$ TRANSMIT PARAMETER NO, NUMBER OF MOVED GAGES
(EXIST DATA OF MOVING ELEMENTS 1 THROUGH n)

10$^H$ TRANSMIT POSITIONING PARAMETERS
(EXIST DATA OF MOVING ELEMENTS 1 THROUGH n)

4F$^H$ (EXIST DATA OF MOVING ELEMENTS 1 THROUGH n)

50$^H$ POSITIONING PARAMETER CHECK SUM
(EXIST DATA OF MOVING ELEMENTS 1 THROUGH n)

51$^H$ ACKNOWLEDGMENT POSITIONING

52$^H$ NON-USED

5F$^H$

60$^H$ TRANSMIT PRESENT POSITION OF MOVING ELEMENT
(EXIST DATA OF MOVING ELEMENTS 1 THROUGH n)

61$^H$

62$^H$ PRESENT POSITION DATA CHECK SUM
(EXIST DATA OF MOVING ELEMENTS 1 THROUGH n)

63$^H$ NON-USED

FF$^H$

FIG.15

PATTERNING UNIT OF WARP KNITTING MACHINE AND CONTROL METHOD THEREOF

BACKGROUND OF THE INVENTION

The present invention relates to a patterning unit of a warp knitting machine and more particularly to a patterning unit which controls the position of a guide point provided on a holding member individually by means of a linear pulse motor and to control methods thereof.

Hitherto, patterning of a warp knitting machine has been carried out by lapping patterning reeds in which guide points are mounted in a direction of row a needles of the patterning reed based on means for lapping the patterning reeds such as a chain drum and an electronic patterning unit. However, because only the same quantity of lapping can be obtained for all the guide points mounted on one patterning reed, the superiority of patterning effect caused by a number of patterning reeds is proportional to the number of patterning reeds.

In view of the prior art problem described above, the present applicant had proposed a new patterning unit previously in Japanese Patent Application No. 06-200750 (PCT/JP95/00032). This patterning unit has been arranged such that guide points are provided individually as part of moving elements in a fixed guide path which corresponds to the patterning reed so as to be movable individually within the guide path.

However, even though the above-mentioned patterning unit patterns through the control of the movement of the moving elements on which the guide points are provided by utilizing linear pulse motors, it has left room for improvement in the following points:

(1) When a number of holding members increases, it is necessary to deal with it by thinning the linear pulse motor further;

(2) It is necessary to solve the problem of short life of a bearing caused by a large attraction force generated between a stator and a moving element of the linear pulse motor;

(3) It is necessary to take measures for preventing erroneous operation due to step-out power failure and external noise in the positioning control;

(4) With the increase of numbers of the holding members and of moving elements, it is necessary to improve a wiring method for wiring connection cables to the moving elements to realize a range in which the moving elements can be moved freely. This is a problem in mounting to the warp knitting machine;

(5) With the increase of numbers of the holding members and moving elements, it is necessary to simplify the assembly and adjustment of the unit. This is a problem in mounting to the warp knitting machine;

(6) It is necessary to correct a pitch error which might be caused by the difference in working precision of pitches of poles of a stator assembled to the holding mer, in working precision of pitches of knitting needles and in expansion coefficient of the holding members due to environmental temperature changes;

(7) In operation, because a plurality of layers of patterning reeds, i.e. the holding members, are disposed, it is necessary to simplify the replacement of the guide point and its alignment with a knitting needle of each moving element which is located behind another; and (8) With the increase of the number of moving elements to be mounted, a control method is required which allows each moving element to be positioned at high-speed in synchronism with the rapid rotation of the warp knitting machine while maintaining the free movable range of each moving element and which can realize the above-mentioned points (3) through (7) at low cost.

SUMMARY OF THE PRESENT INVENTION

Accordingly, it is an object of the present invention to provide a patterning unit of a warp knitting machine and control methods thereof which are arranged so as to solve each of the problems described above.

The present invention is arranged such that in a patterning unit of a warp knitting machine in which a stator of a linear pulse motor is assembled in a holding member functioning as a guide path and a plurality of moving elements are provided at arbitrary intervals on the same path, part of the moving element is constructed as a guide point or a guide bar, and poles of the moving element are disposed so as to face to poles on both sides of the stator.

Thereby, attraction suction forces generated between the stator and the moving element cancel each other and the burden placed on a bearing section is reduced as a result. Therefore, the thickness of the poles of the moving element may be reduced to about a half without dropping a thrust of the moving element. Accordingly, an increased number of the holding members is made possible by thinning the linear pulse motor.

The present invention is also arranged such that in the patterning unit described above, coils of the poles of the moving element, i.e. moving element driving coils, NS directions of two field magnets within the moving elements facing to the poles on the both sides of the stator and teeth of the stator are set so that a magnetic path of the field magnets runs in the sane direction.

Thereby, a leakage magnetic flux is reduced and the magnetic flux generated by both field magnets and the excited coils pass through each pole, so that the thrust may be uniform and the guide point is be positioned stably.

Further, the present invention solves the aforementioned problems in the patterning unit of the warp knitting machine in which a stator of a linear pulse motor is assembled in a holding member functioning as a guide path and a plurality of moving elements are provided at arbitrary intervals on the same path and part of the moving element is constructed as a guide point or a guide bar, by adopting the following control methods.

A first inventive method for controlling the patterning unit of the warp knitting machine described above is to control the acceleration or deceleration of the linear pulse motor by providing a position sensor in connection with the poles of the stator and the poles of the moving element and by confirming by the position sensor that the poles of the moving element have moved a unit of one pulse with respect to a positioning command to generate a next positioning pulse.

Thereby, information for positioning the moving element is logically incorporated as moving conditions in the positioning control commands, so that the moving element follows reliably in accordance with the command values and is positioned accurately. At this time, the correction of position and the like may be readily made, thus guaranteeing more accurate positioning control by controlling the positioning by setting a number of pulses per gage at a plurality of pulses.

A second inventive method for controlling the patterning unit of the warp knitting machine described above is to provide absolute position detecting means whose span is adjusted according to the pitch of the pole of the stator disposed in the holding member to control the relationship between a position detected value detected by the position detecting means and the excitation of the moving element driving coils.

Thereby, the position of the moving element is always detected so that the moving element is caused to follow in accordance with the position control command values, it thus becomes unnecessary to return to the reference position by performing a zero return operation even if power is turned on again after power failure and the machine will not step out due to electrical noise and external noise such as a difference in tension of patterning yarns and in yarn feeding methods.

A third inventive method for controlling the patterning unit of the warp knitting machine described above is to control the positioning of the moving element by carrying out optimum positioning acceleration or deceleration by finding current control and excitation switching timings of the moving element driving coil from the position detected value. Thereby, it becomes possible to carry out the positioning reliably in a short time, to execute a stop at the accurate position and to prevent step-out.

A fourth inventive method for controlling the patterning unit of the warp knitting machine described above is to control the positioning of the moving element freely by way of wireless control by supplying electric power and transmitting signals to the moving element by using a non-contact method utilizing a magnetic coupling of a power receiving coil of the moving element and an induction coil attached to the holding member or a contact method in which a conductive portion is provided on a part of the holding member and a slip ring is contacted. Thereby, it becomes possible to realize the small and light-weight machine, to increase the thrust and to increase the speed.

A fifth inventive method for controlling the patterning unit of the warp knitting machine described above is to control the positioning of the moving element by mounting a microcomputer or a logic circuit on the moving element to reduce an amount of control signals transmitted to the induction coil for the correction of position and the like.

In this case, even if the amount of information to be transmitted by the induction line increases and the processing capacity of the moving element positioning control computer increases, the positioning of the moving element may be controlled individually by the microcomputer or the logic circuit mounted on the moving element without being restricted by the amount of information of the control signals. Then, it allows the load of the moving element positioning control computer to be reduced significantly, the positioning to be accommodated with the high speed rotation and to be controlled accurately at high speed, thus allowing the machine to be put into more practical use.

BRIEF DESCRIPTION OF DRAWINGS

FIG. 15 is an explanatory diagram of an exemplary data array of the control signal transmitted by a control signal induction coil;

DETAILED DESCRIPTION OF THE INVENTION

The present invention will be explained below with reference to the drawings.

Figure 1:
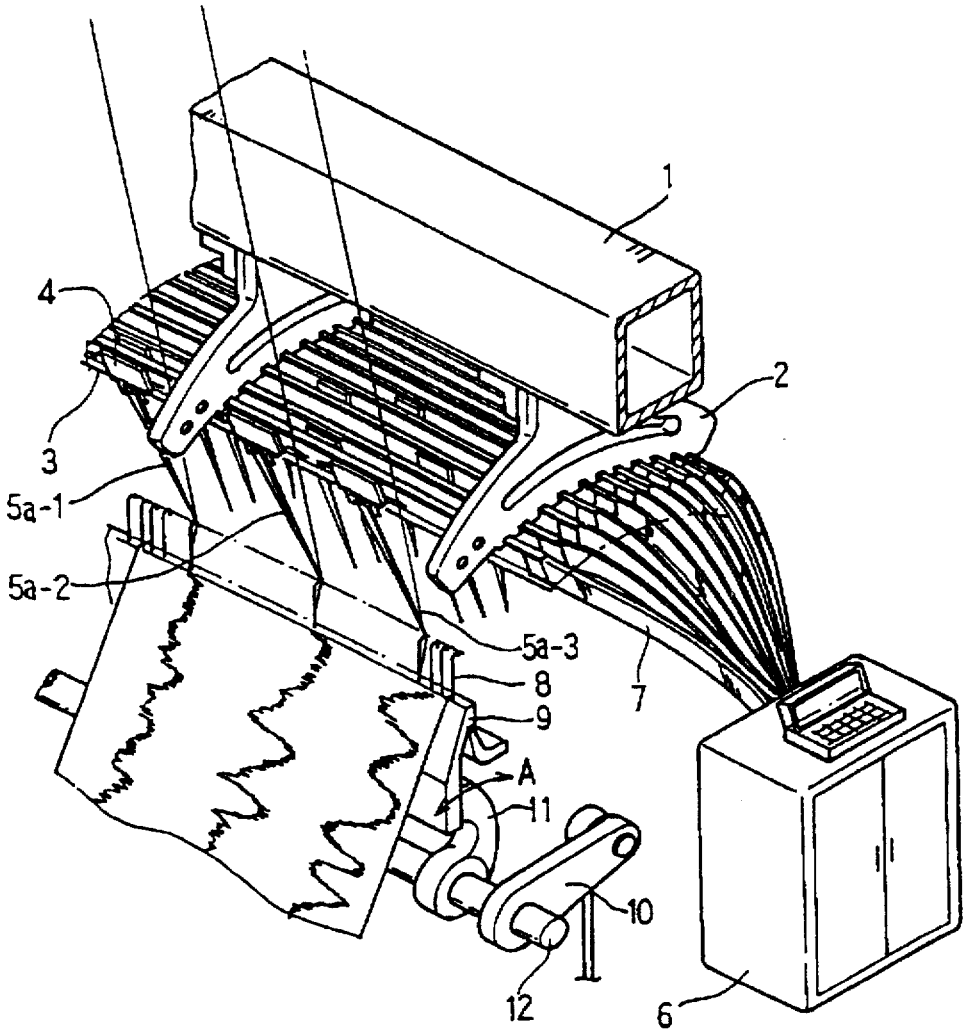
FIG. 1 is a schematic perspective view of a warp knitting machine to which one em it of an inventive patterning unit and a control method thereof is applied.

FIG. 1 is a schematic perspective view of a warp knitting machine to which one embodiment of a patterning unit and a control method of the present invention is applied. The reference numeral (1) denotes a traverse which is part of a machine frame, (2) hanger suspended from and fixed to the traverse 1 at intervals of a certain distance, (3) holding members in each of which a stator of a linear pulse motor extends in a direction of width of the knitting machine and a certain number of which are fixed to the hanger 2 in parallel, and (4) moving elements which reciprocate linearly on the holding member 3 and to each of which a guide point 5 (5*a*-1, 5*a*-2, 5*a*-3) is attached. Normally, several to ten-odd moving elements 4 are mounted to the holding member 3 which constitutes, at least partly, the stator of the linear pulse motor across the width of the knitting machine so as to be movable in accordance to a patterning program.

Provided within a control section 6 are known control units, i.e. a position control circuit, a linear pulse motor driving circuit, a position detecting circuit and a patterning computer with a memory. Because their structure is well known, an explanation. A position controlling method of the linear pulse motor is explained below in detail with reference to FIGS. 4, 5, 6 and 7 because it is an essential part of the present invention.

Each holding member 3 has a signal cable 7 as one of means for transmitting signals to each moving element 4 at one end thereof. The reference numeral (8) denotes knitting needles, (9) a trick plate, and (10, 11) a lever and an arm for driving the trick plate 9 which are mounted to a supporting shaft 12. The trick plate 9 is oscillated together with the knitting needles 8 in a direction of A. Any type of knitting needles beside those conventionally used such as a composite needle, a latch needle, a beard needle and the like way be used for the knitting needle 8 so long as it has a similar function.

Next, a structure of a driving section containing the stator of the linear pulse motor incorporated in the holding member 3 and the moving element 4 will be explained.

Figure 2:
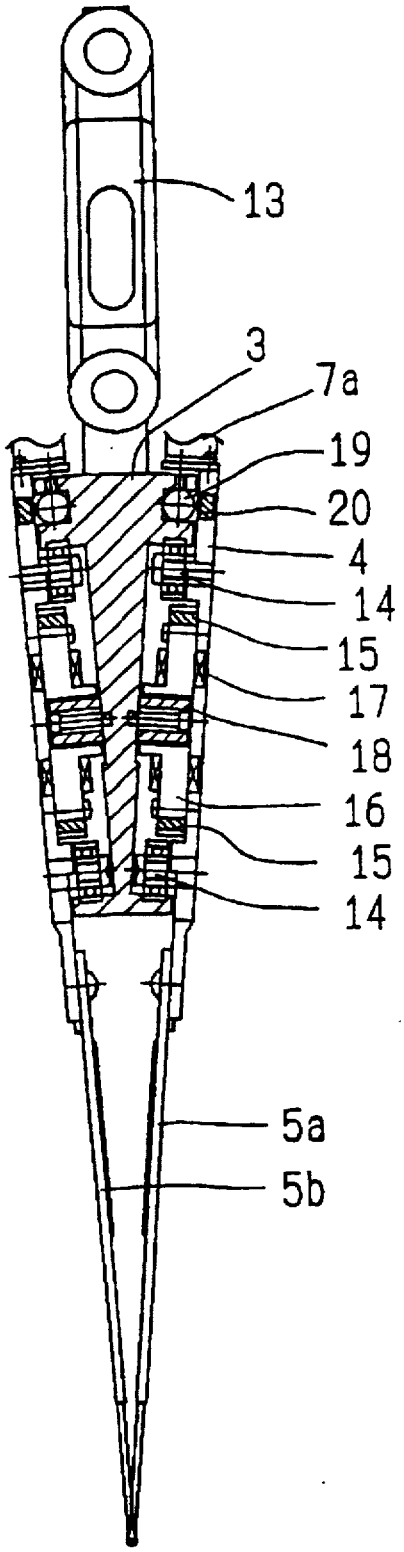
FIG. 2 is a section view of a holding member, including a guide point, showing a structural example in which two sets of poles of a stator are disposed on the both sides of the holding member in the patterning unit in FIG. 1.
Figure 3:
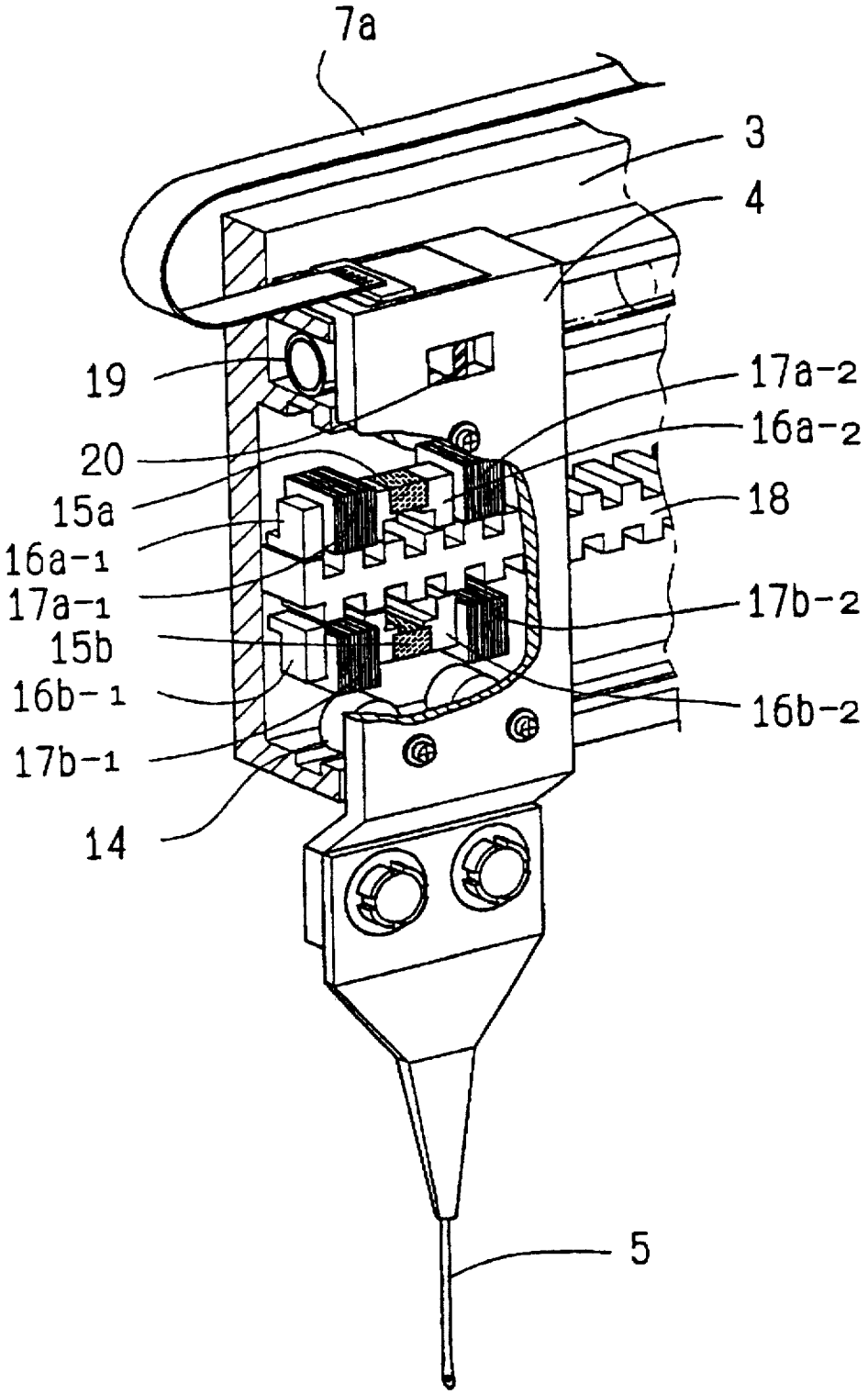
FIG. 3 is a partly cutaway perspective view showing the embodiment in which a linear pulse motor in which poles of a moving element are disposed so as to face to the poles of the stator on the both sides and a magnetostrictive sensor, used for detecting the position of the moving element, are mounted in the patterning unit in FIG. 1.

FIG. 2 is a longitudinal section view of an embodiment in which the moving elements 4 are attached to the both sides of the holding member 3 provided on a holder 13 and FIG. 3 is a partly cutaway perspective view of one side thereof. The stator 18 on which toothed poles are formed on both sides thereof is provided in the holding member 3 across the whole length of the knitting width so that the moving elements 4 may be moved throughout the knitting width. Normally, several to ten-odd moving elements 4 (4-1, 4-2, . . . 4-n) are mounted to the holding member 3. A moving element bearing 14 holds the moving element 4 and the guide point 5 attached to the moving element 4.

The moving element 4 of the linear pulse motor is constructed as follows. In the figure, the reference numerals (15: 15*a*, 15*a*) denote field magnets (magnets), (16: 16*a*-1, 16*a*-2, 16*b*-1, 16*b*-2) poles of the moving element, and (17: 17*a*-1, 17*a*-2, 17*b*-1, 17*b*-2) moving element driving coils. The poles 16*a*-1 and 16*a*-2 of the moving element and the moving element driving coils 17*a*-1, 17*a*-2 and the poles 16*b*-1 and 16*b*-2 and the moving element driving coils 17*b*-1 and 17*b*-2 are disposed so as to face to the poles of the stator 18 in order to cancel out large attraction forces generated between the poles 16 of the moving elements 4 and the poles of the stator 18. Thereby, because a load placed on the moving element bearing 14 as well as the gap between the both poles may be reduced, a thrust is maintained, heat generated is reduced, the miniaturization of the bearing and the prolongation of its life is realized by reducing an exciting current applied to the moving element driving coils 17. Further, the whole moving element 4 may be thinned by miniaturizing the moving element driving coils 17 and the moving element electrodes 16.

A magnetostrictive absolute sensor probe 19 is mounted across the whole range of the knitting width of the holding member 3. A position detecting sensor magnet 20 is mounted on each moving element 4 (4-1, 4-2, . . . 4-n) (See FIG. 5). The magnetostrictive absolute sensor probe 19 detects the position of each moving element 4 by detecting the position of the sensor magnet 20 of the moving element 4 on the holding member 3 to create data for controlling the position. A flexible cable is used as a signal cable 7*a* connecting a linear pulse motor driving circuit provided in the control unit with the moving element driving coil 17 of the moving element 4 to allow the moving element 4 to move freely. The signal cable 7*a* is explained below with respect to an embodiment in which the cable is eliminated.

Figure 4:
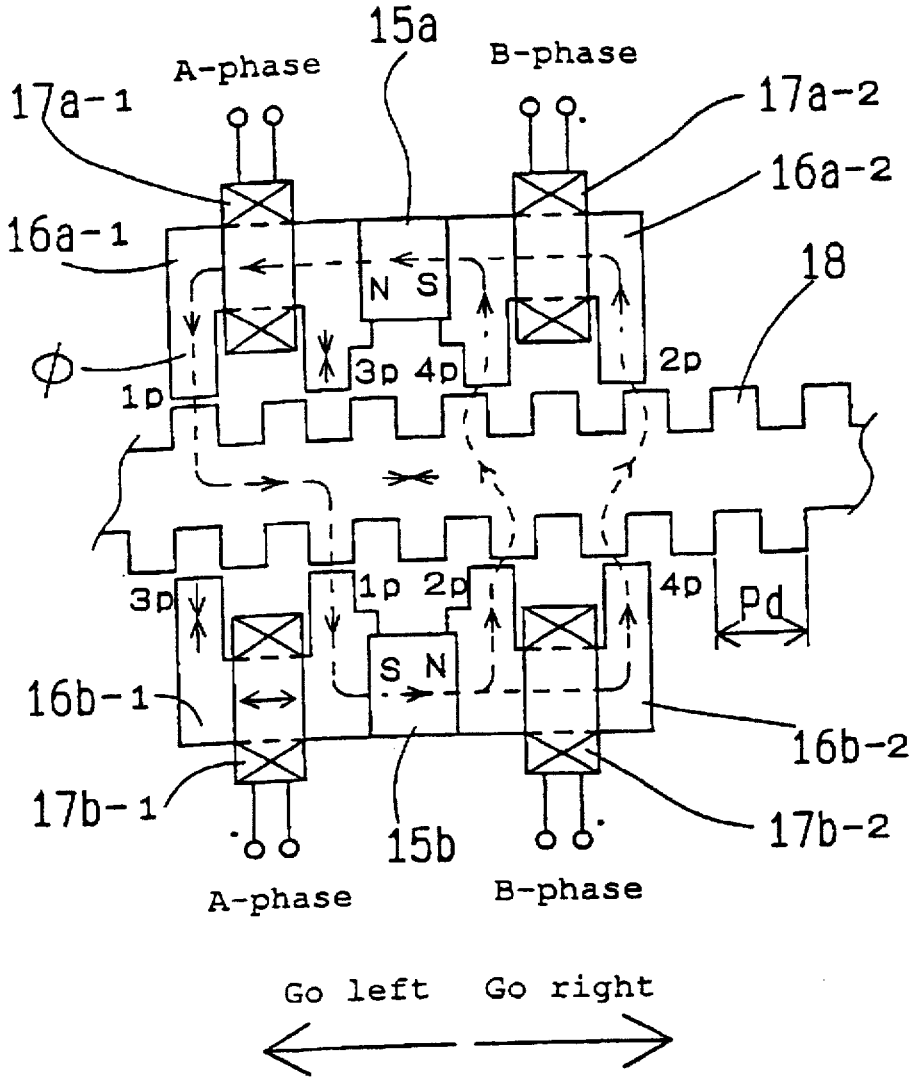
FIG. 4 is a structural view showing a relationship between the poles of the moving elements and the poles of the stator of the linear pulse motor in the patterning unit in FIG. 1.

FIG. 4 is a structural diagram showing a relationship between the poles of the moving element and the poles of the stator of the linear pulse motor of the patterning unit of the present invention. Because its basic structure is known, a detailed explanation of its basic operation is omitted and its operational principle is explained only about the part related to the present invention.

Several problems are solved by disposing two sets of the poles 16 of the moving elements and the moving element driving coils 17 so as to face to the poles on the both sides of the stator 18, by arranging phases of the upper and lower teeth, i.e. the poles of the stator 18, so as to be opposite, and by configuring directions of NS of the upper and lower field magnets 15*a* and 15*a* to be also opposite.

While it has been described with respect to the explanation of FIGS. 2 and 3 that the load placed on the moving element bearing 14 can be reduced significantly by adopting the structure in which the attraction forces generated between the upper and lower poles are canceled, it is also a solution for the biggest problem of the linear pulse motor used in the inventive unit. Further, because the gap between the poles is minimized by solving the problem of the attraction force, the thrust is increased. While it has been also described before, a difference in magnetic flux density is caused between the inner poles close to the field magnets 15*a* and 15*a* and the outer poles due to a difference in resistance of magnetic paths and leakage flux from the prior art structure, causing a dispersion of the thrust among the inner and outer poles. This problem is solvable in the present invention by configuring the two sets of upper and lower linear pulse motors by assorting the inner poles with the outer poles, by arranging (alternating) the upper and lower teeth of the poles of the stator 18 so as to be opposite and by arranging the NS directions of the field magnets 15*a* and 15*a* so as to be also opposite.

Further, the dispersion of the thrust is minimized and the performance of position control is improved by connecting the upper and lower moving element driving coils 17*a*-1 and 17*b*-1 for A phase to the same phase and connecting the upper and lower moving element driving coils 17*a*-2 and 17*b*-2 for B phase to the same phase in the same manner to set the pole Nos. 1*p*, 2*p*, 3*p* and 4*p* of the moving elements shown in FIG. 4 so that when the upper side ones are positioned outside, the lower side ones are positioned inside and when the upper side ones are positioned inside, the lower side ones are position outside.

As shown by a broken line in FIG. 4, the path $\phi$ of the magnetic flux generated when the field magnets 15*a* and 15*a* and the moving element driving coils 17*a*-1 and 17*b*-1 are excited always passes through both the upper field magnet 15*a* and the lower field magnet 15*a*, thus providing a highly efficient thrust. The highly efficient thrust is obtained also when the moving element driving coils 17*a*-2 and 17*b*-2 are excited by the same reason.

In the present embodiment, a pitch Pd of the pole of the stator 18 is set at four times of a gage pitch (1/18 inch=1.411 mm) of the guide point. In the structure shown in FIG. 4, the movement per pulse is 1.411 mm in the case of one-phase excitation or two-phase excitation as it is known. The movement per pulse is 0.705 mm in the case of the one-two-phase excitation method. In the present embodiment, a combined method of the one-phase excitation and the one-two-phase excitation is adopted in order to carry out the position control per 1.411 mm pitch. The position control method is described below with reference to FIGS. 5, 6 and 7.

Figure 5:
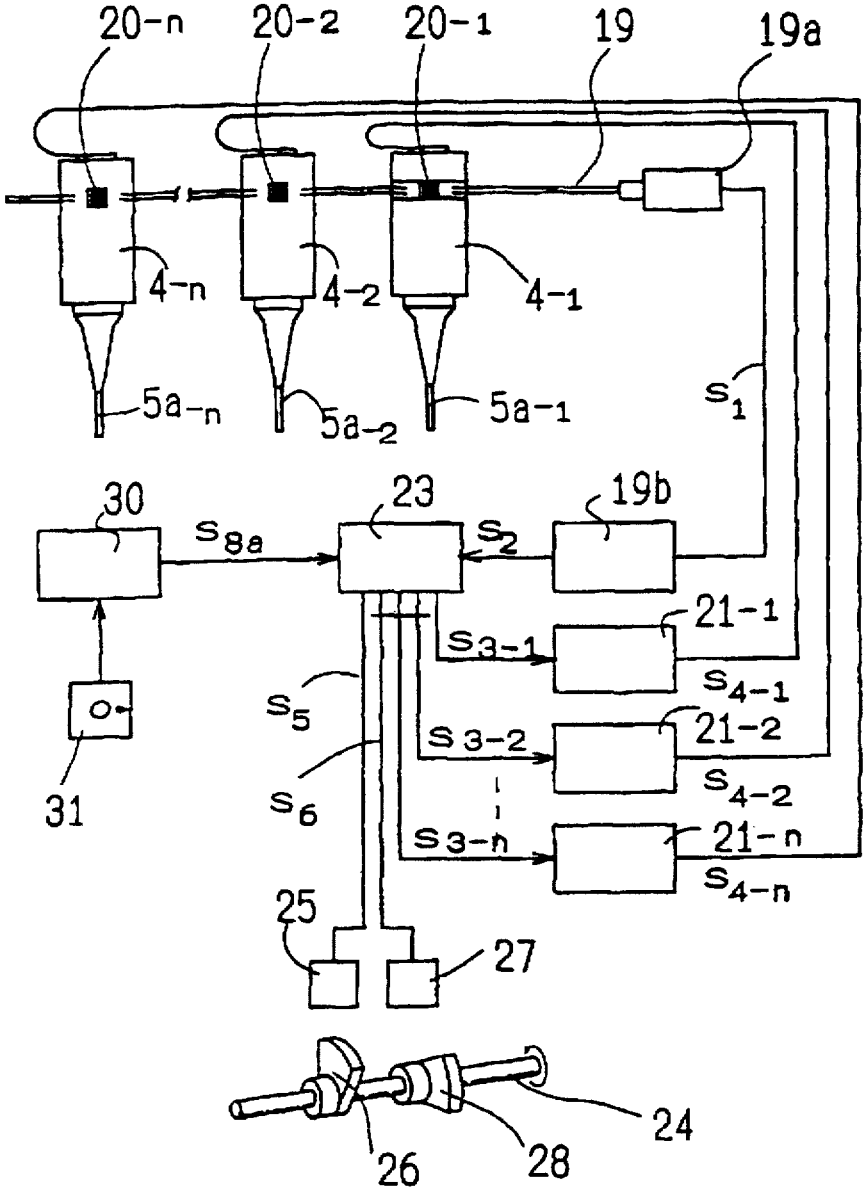
FIG. 5 is a block diagram showing one example of a control mechanism for controlling the patterning unit by the linear pulse motor in the patterning unit in FIG. 1.

Next, an exemplary control method of the patterning unit of the above-mentioned embodiment of the present invention is explained with reference to FIG. 5.

The reference numeral (30) denotes a computer for pattern control. A pattern data disk 31 prepared beforehand based on lace pattern structures is read into an internal memory of the pattern control computer 30. This pattern data which is to be decomposed per holding member by a moving element positioning control computer 23 of each holding member, is transmitted as a pattern data signal S8a and is stored in the memory in the moving element positioning control computer 23. When the knitting machine is driven, periodic signals S5 and S6 are sent from a proximity sensor 25 and a disk 26, for the proximity sensor 25 for an underlap starting signal provided on a main shaft 24 of the knitting machine and from a proximity sensor 27 and a disk 28, for the proximity sensor 27 for an overlap starting signal, respectively, to the moving element positioning control computer 23.

Each of the pattern guide point moving elements 4-1, 4-2, . . . 4-n disposed on the holding member 3 contains the linear pulse motor and its position is controlled by exciting the roving element driving coils. The reference numerals (20-1, 20-2, . . . 20-n) denote magnets for sensors for detecting the position of the moving elements, (19) the magnetostrictive absolute sensor probe for detecting the position of the moving elements, (19*a*) a sensor amplifier, (19*b*) a circuit for detecting the position of each moving element by counting an output signal S1 of the sensor amplifier 19*a*, and (21-1, 21-2, . . . 21-n) pulse motor driving circuits for sending signals S4-1, S4-2, . . . S4-n for exciting the moving element driving coils of the linear pulse motor to each of the moving elements 4-1, 4-2, . . . 4-n to position them.

The moving element positioning control computer 23 controls the position of each of the guide points 5*a*-1, 5*a*-2, . . . 5*a*-n attached to the moving elements 4-1, 4-2, . . . 4-n in accordance to the pattern data based on positional elements 4-1, 4-2, . . . 4-n stored therein and moving element position detected signals S2 and signals generated by commands S3-1, S3-2, . . . S3-n for positioning the moving elements 4-1, 4-2, . . . 4-n which are synchronized with the periodic signals S5 and S6 of the main shaft of the knitting machine, are transmitted by the pulse motor driving circuits 21-1, 21-2, . . . 21-n.

Further, as a known method for controlling the position of the pulse motor, there is a method of guaranteeing the prevention of step-out during startup and positioning to a target position by generating slow-up and slow-down pulses. However, this slow-up and slow-down method cannot guarantee 100% accuracy due to the fluctuation of load and external noises even if a safety factor is increased.

The present embodiment is adapted to carry out the positioning reliably in the shortest time using a control method explained in detail below referencing FIGS. 6 and 7.

Figure 6:
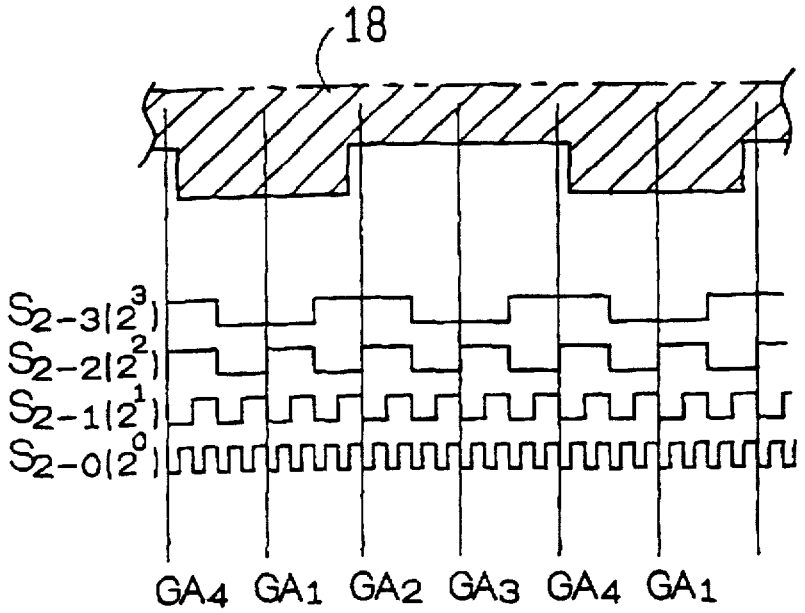
FIG. 6 is a signal waveform chart of output signals of the magnetostrictive absolute sensor for detecting the position of the poles of the moving element and the position of the pole of the stator in the patterning unit in FIG. 1.

FIG. 6 shows a relationship between the output signals of the magnetostrictive absolute sensor and the poles of the stator 18. In the present t, the pitch of the pole of the stator 18 corresponds to four gages and there are four ways of positioning positions of GA1, GA2, GA3 and GA4.

In the present embodiment, the position detecting circuit is designed so as to detect the position in unit of ⅛ of the movement of one gage (1.411 mm) from GA1 to GA2. When the span of the knitting width of the holding member 3 is adjusted and positioned so that the output signals of the magnetostrictive absolute sensor agree with the pitch of the pole of the stator 18, the relationship shown in FIG. 6 is obtained as a result.

Position detection values are represented by binary numbers like S2-0 (20), S2-1 (21), S2-2 (22), S2-3 (23) . . . . Although S2-4 and above are omitted, they are detected by values of 16 bits. Accordingly, as for a guide address, the unit of S2-3 (23) becomes a guide address detection value of the guide point (moving element). Three bits S2-0, S2-1 and S2-2 below that are information on movement required for the positioning control of the linear pulse motor.

Figure 7:
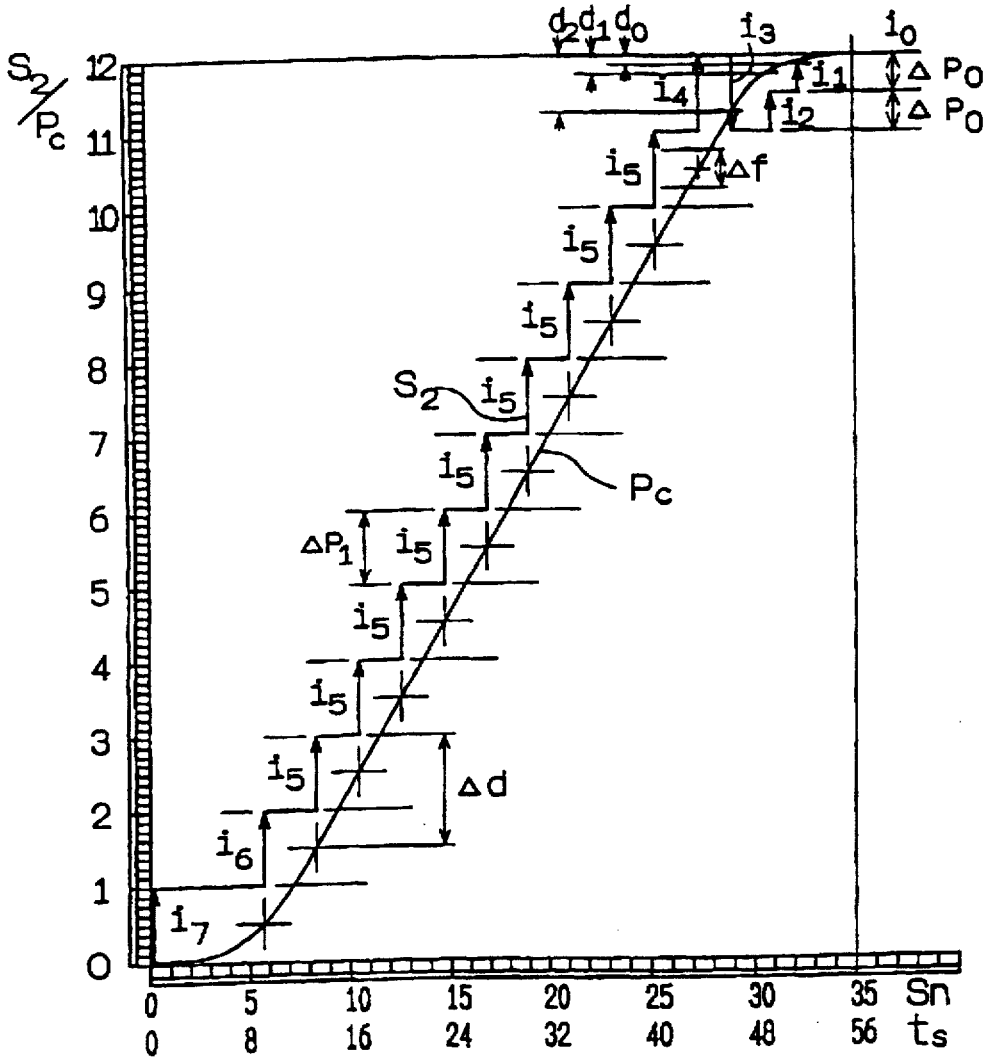
FIG. 7 is a graph showing a relationship among position control parameters of the linear pulse motor in the patterning unit in FIG. 1.

FIG. 7 represents a relationship among positioning control parameters of the linear pulse motor. The reference symbol (Pc) denotes a position detected value of the moving element 4, (S2) a signal for exciting the moving element driving coil 17 of the linear pulse motor, (i0, i1, i2, i3, i4, i5, i6, i7) exciting current parameters of the moving element driving coil 17, and (ΔP0, ΔP1) the movement per pulse of the linear pulse motor. That is (ΔP0) is the movement in case of the one-two-phase excitation and (ΔP1) is the movement in case of the one-phase excitation. (Sn) of the horizontal axis represents a number of times of sampling for detecting the position. The sampling period is 1.6 msec. in the present embodiment. (ts) denotes time (isec). (Δf) represents a speed of the moving element 4 and indicates a varied movement of a detected value in one sampling period. (d0, d1, d2) denote control parameters indicating distances to positioning target values. (Δd) denotes a parameter of an allowance between a position detected position and a position for exciting the moving element driving coil of the linear pulse motor. Δd is important as a parameter for preventing step-out and is set as $\Delta d \leqq 12$ in the detected value. It is set as $\Delta d \leqq 12$ in the present embodiment considering the safety factor because the step-out condition is brought about when $\Delta d \leqq 16$ as it is well known.

An embodiment concerning to each parameter and the positioning control method will be explained below.

A positioning time of the moving element synchronized with a number of revolutions of the knitting machine of 400 rpm to 450 rpm is within 50 msec. in the underlap positioning and within 18 msec. in the overlap positioning. While there is a fluctuation of the allowance more or less depending on a number of the holding members, the reliable positioning is guaranteed in a short time in any case. The lapping illustrated in FIG. 7 presents the movement of 12 gages. Positioning is started by the underlap starting signal and, at the startup for the start dash, the rise time is minimized by charging the current of i7 and i6 fully for the performance of the driving circuit. It is accelerated by adding ΔP1=8 when the position detected value approaches to a difference with the exciting position Δd=4 to move the exciting position. While it turns out as Δd=12 at that moment, the exciting position is moved further when the detected position of the moving element approaches to Δd=4, thus repeating this process sequentially until reaching to the target position. This method represents the shortest startup of the moving element conforming to a time constant of inertia thereof. This control is performed with the period of the position detecting sampling of 1.6 msec.

Control parameters and a control method for stopping at the next target value will be explained. While the stopping control starts at the point of time when the position of the signal S2 for exciting the moving element driving coil of the linear pulse motor reaches to the target position as described above, the moving element is at the position distant from the target position by 1.5 gage at the point of time when the signal S2 reaches to the target because $\Delta d \leqq 12$. Then, a moving velocity $\Delta f$ at that time is found. The operation of FIG. 7 is then carried out in accordance to d0, d1 and d2 and the exciting currents of i1, i2 and i3 set in advance by the value of $\Delta f$, as follows.

At first, when the position approaches to d2 with respect to the target value, the exciting position is returned by $\Delta P1$ to excite the point one gage before the target value. Assume the exciting current at this time as i3. That is, it acts as a brake for stopping at the target position. Next, the exciting position is approached to the target position by $\Delta P0$ at the point of time when it approaches to the position of d1. The exciting current at this time is i2. Then, when the exciting position is advanced by APO at the point of time when it approaches to the position of d0, the exciting position reaches to the positioning target. The exciting current at this time is i1.

The above control method allows the moving element to be stopped at the target position in the shortest time by optimally setting the parameters $\Delta f$, d0, d1, d2, i1, i2 and i3. i0 is the exciting current after the stop and a current value conforming to a torque for holding the stop is selected.

The method of the present embodiment allows the positioning in the shortest time by controlling the position detected position of the moving element and the exciting position of the moving element driving coil, i.e. the command value, always at intervals of the period of the position detecting sampling of 1.6 msec. and by controlling always so as to prevent the step-out which is the biggest problem of the linear pulse motor.

The control parameters may be applied to all the moving elements so long as they have the same structure by setting the optimal values once.

The performance of the patterning unit nay be improved further by minimizing the dispersion of thrust by constructing the linear pulse motor as shown in FIG. 4 as described above and by reducing the thickness and weight of the moving element and by increasing the thrust.

Next, an t in which power is supplied and control signals are transmitted in a non-contact manner without using cables, will be explained as a method for controlling each driving coil of the moving elements 4-1, 4-2, . . . 4-n for the guide points disposed on the holding member 3. This embodiment solves the problems of the restricted movement range of the moving element and the short life of the cables as well as the problem in mounting and realizes free patterning by eliminating the connection cables to the moving elements.

Figure 8:
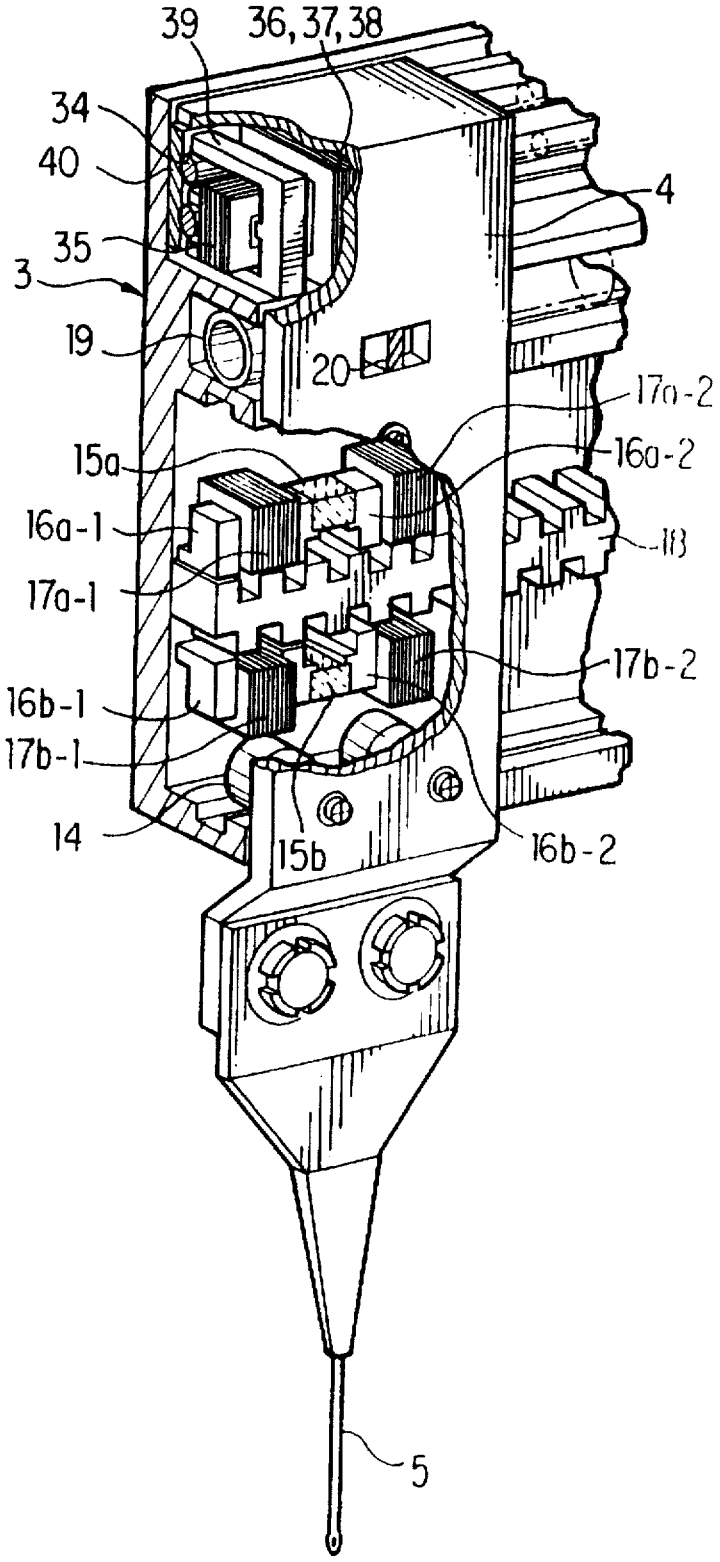
FIG. 8 is a partly cutaway perspective view an embodiment of a patterning unit without connection cables.

FIG. 8 shows one example of the patterning unit from which the connection cables are removed. The parts structurally common with those in FIG. 3 are designated with the same reference numerals and an explanation thereof is omitted. Only parts added to the upper edge portion are explained below.

A unit is formed by assembling a ferrite plate 40 secured to the holding member 3, an induction coil 34 secured in parallel with the ferrite plate 40 in the longitudinal direction, a power receiving coil 35 provided in correspondence with the induction coil 34 at the upper part of the moving element 4, a rectifier circuit 36, a driving circuit 37 and a signal detecting circuit 38.

Figure 9:
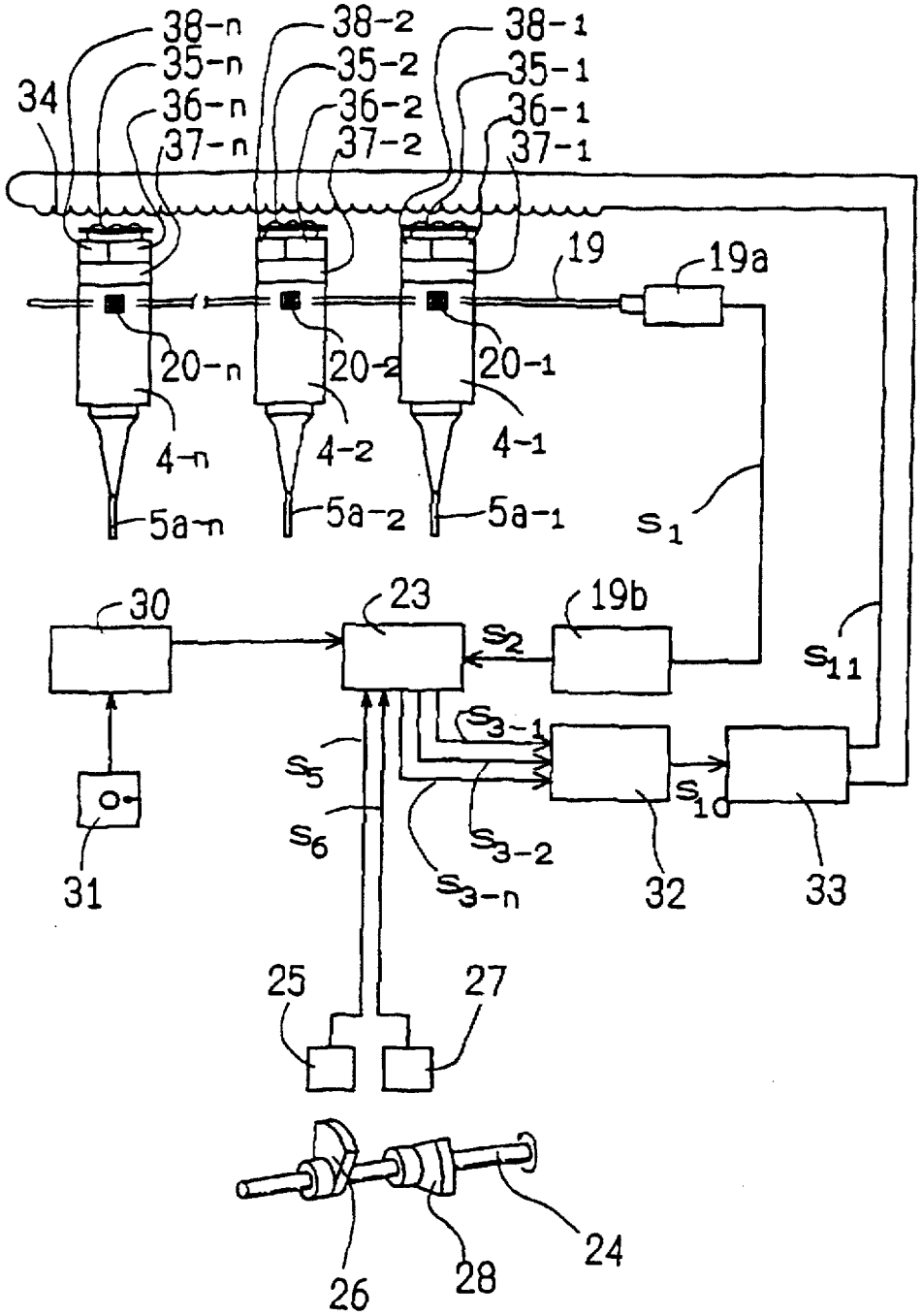
FIG. 9 is a block diagram showing one example of a control mechanism of a unit according to an embodiment in which power is supplied and control signals are transmitted by a non-contact method in the patterning unit in FIG. 8.
Figure 10:
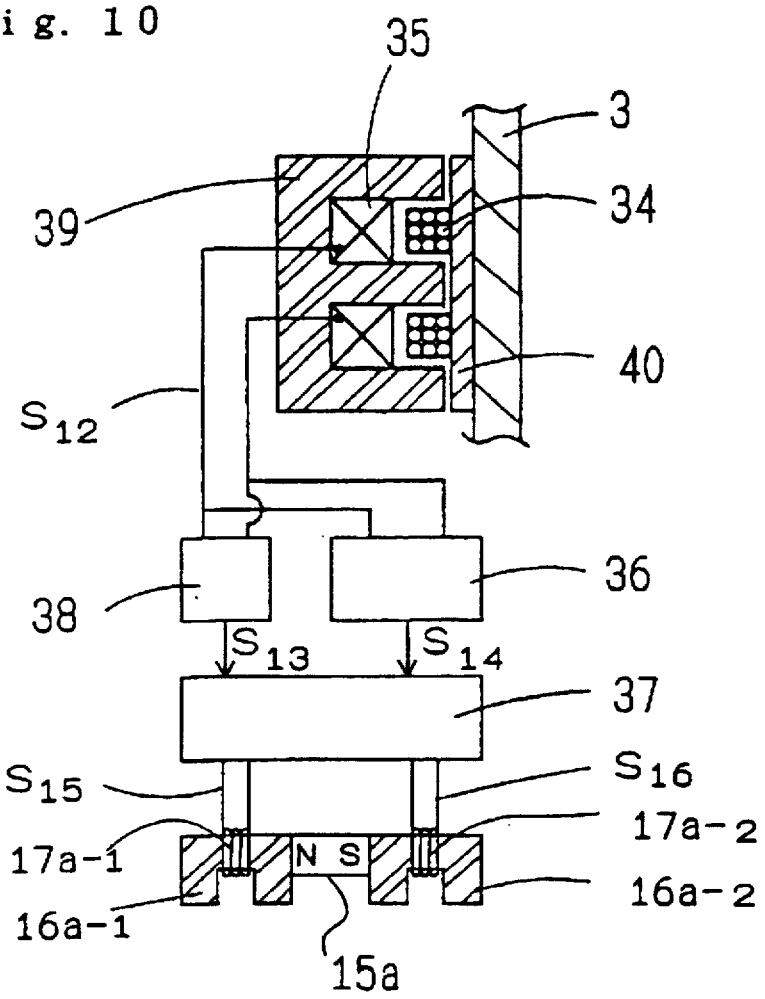
FIG. 10 is a block diagram showing one example of a control mechanism of the moving element, an induction coil and a receiving coil in the patterning unit in FIG. 8.
Figure 11:
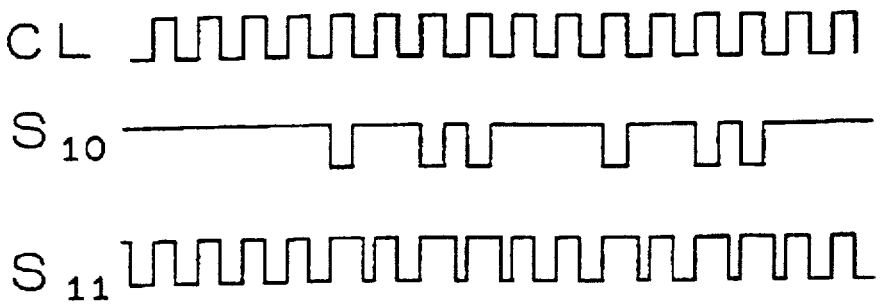
FIG. 11 is a signal waveform chart showing an example of signals of a power supplying oscillation section of the moving element in the patterning unit in FIG. 8.

A control method using the above-mentioned unit is explained referencing FIGS. 9, 10 and 11. It is noted that the explanation of the control method common with that in the previous embodiment shown in FIG. 5 is omitted and only the additional control method is explained.

Commands S3-1, S3-2, . . . S3-n for positioning the moving elements 4-1, 4-2, . . . 4-n generated by the moving element positioning control computer 23 in FIG. 9 are input to a signal converter circuit 32 to be converted into a serial pulse signal S10 which is input to a power supplying and oscillating section 33. The power supplying and oscillating section 33 outputs a power signal Sll whose oscillation frequency is modulated by the serial pulse signal S10 for positioning the moving element and excites the induction coil 34 attached on the holding member 3.

The moving elements 4-1, 4-2, . . . 4-n can obtain induced power caused by the magnetic coupling between the power receiving coils 35-1, 35-2, . . . 35-n and the induction coil 34 and in the same time, receive the control signal.

A method for controlling the moving elements 4-1, 4-2, . . . 4-n will be explained with reference to FIG. 10. The induced power S12 generated in the power receiving coil 35 is input to the control signal detecting circuit 38 and the rectifier circuit 36 and a control signal S13 and a DC voltage signal S14 are input to the linear pulse motor driving circuit 37. Then, control signals S15 and S16 excite the moving element driving coils 17*a*-1 and 17*a*-2. Thus, the position of each moving element is controlled in the same manner with above.

FIG. 11 shows exemplary signal waveforms of a basic oscillation signal CL of the power supplying and oscillating section 33 and the power signal S11 which has been pulse-width modulated by the positioning command serial pulse signal S10.

While the t in which the power is supplied together with the control signal is explained above, it is conceivable, to adopt a method of supplying the power and transmitting the control signal by two line systems described below. In any case, the more the number of moving elements disposed on the same holding member, the greater the effect of removing the connection cables becomes. While the weight of the moving element increases by adding the power receiving coil 35, the power receiving coil ferrite core 39, the control signal detecting circuit 38, the rectifier circuit 36 and the linear pulse motor driving circuit 37, a light-weight, thin and high-thrust patterning unit may be realized and be put into practical use due to the effect of the patterning unit an opposing pole structure.

It is noted that beside the non-contact method described above, positioning control by way of wireless control similar to one described above may be implemented by a contact method of supplying signals and power by providing a conductive portion on a part of the holding member and by contacting it with a slip ring provided on the moving element.

Figure 12:
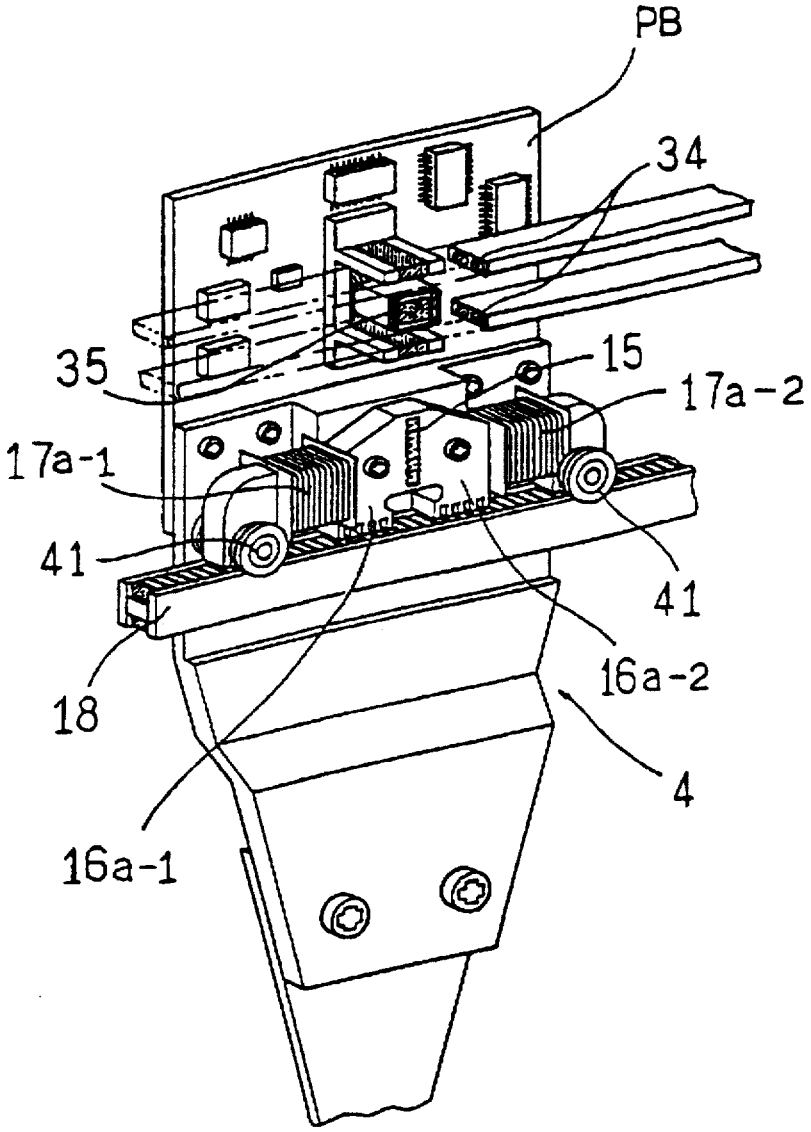
FIG. 12 is a partly cutaway perspective view of an embodiment in which the poles of the moving element are disposed so as to face only to one side of the poles of the stator.

FIG. 12 shows an embodiment in which poles of the moving element 4 are disposed so as face to poles at one side of an upper or lower side (upper side in case of the figure) of the stator 18 provided in the knitting width direction in the holding member (not shown).

In the figure, the reference numeral (15) denotes a field magnet, (16*a*-1, 16*a*-2) poles of the moving element, and (17*a*-l, 17*a*-2) moving element driving coils. Moving rollers 41 are provided before and after the both poles 16*a*-1 and 16a-2 and are placed on the stator 18 formed so that the moving rollers 41 function also as a guide so as to be able to move the moving element in the knitting width direction. Because an induced power is obtained by the magnetic coupling of the induction coil 34 and the power receiving coil 35, a necessary power is supplied by it. This point is the same with the case in the embodiment in FIG. 8.

FIG. 12 also shows a case in which a microcomputer or a logic circuit is mounted on the moving element 4 to control the moving element 4 thereby reducing the control signals of the induction coil 34 for the correction of position and the like. Accordingly, the figure shows microcomputer chips attached on a substrate PB.

That is, although the case in which the control is made by setting the movement per pulse of the linear pulse motor at the gage pitch (1.411 mm) has been shown in the embodiment of the control method described above, it is desirable to select a control method in which the movement per pulse is set at one-several of 1.411 mm per pulse described above, e.g. one quarter in order to solve the problems of the working precision of the stator, the working precision of the pitch of the knitting needles, the correction of the pitch error, the simplification of the alignment and the increase of the speed. More desirably, the one-two-phase exciting method is adopted to correct the position of the moving element, temperature and individual guide position in unit of 0.176 mm per pulse.

However, if it is set at a plurality of pulses per move of one gage, an amount of information to be transmitted by the induction lines increases four times and in the same time, the processing capacity of the moving element positioning control computer 23 has to be increased four times or more. Further, carrier frequency of the induction line becomes high frequency of more than four times and it becomes difficult to realize it because of the high cost in the aspects of the mounting and processing capacity.

It is preferable, therefore, to adopt the following control method after setting a number of pulses for moving one gage at a plurality of pulses, e.g. four pulses or eight pulses, as shown in the embodiment.

Firstly, the microcomputer is mounted on the moving element 4 to carry out the positioning control individually in order to significantly reduce the amount of information carried by the control signal induction line. Secondly, two lines consisting of the power supplying induction line and the control signal induction line are provided so that resonance frequency can be set in accordance to an inductance of the power supplying induction line without being restricted by the amount of information of the control signal.

The processing capacity is dispersed and the load of the moving element positioning control computer 23 is significantly reduced by adopting this control method.

Figure 13:
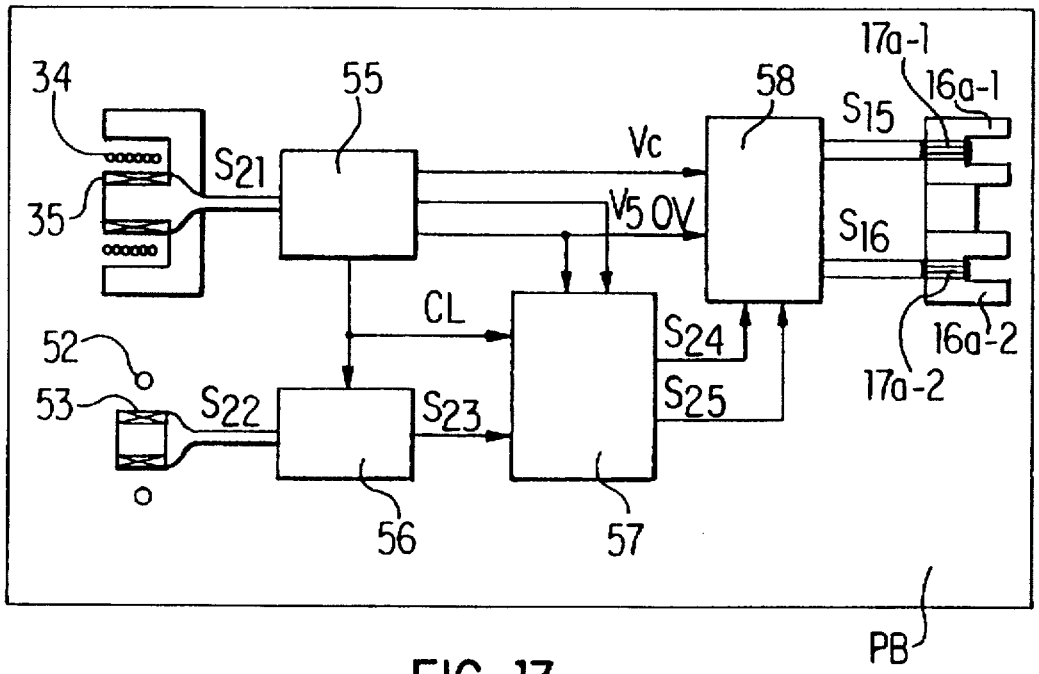
FIG. 13 is a block diagram showing one example of a positioning control mechanism using microcomputers mounted to the moving element.

FIG. 13 shows one example of a control mechanism controlled by the computer mounted on the moving element 4.

It comprises the power receiving coil 35 provided corresponding to the power supplying induction coil 34 secured to the holding member and a signal receiving coil 53 provided corresponding to the control signal induction coil 52 secured to the same holding member together with the power supplying induction coil. An output signal S21 of the power receiving coil 35 is input to a power receiving section 55 to output a controlling power source VS and a power source Vc for the pulse motor driving circuit 58. Further, an output signal S22 of the control signal receiving coil 53 for shaping the output signal S21 of the power receiving coil 53 and for outputting a control signal synchronizing signal CL is input to the control signal receiving section 56 to be shaped as a serial control signal S23.

Figure 14:
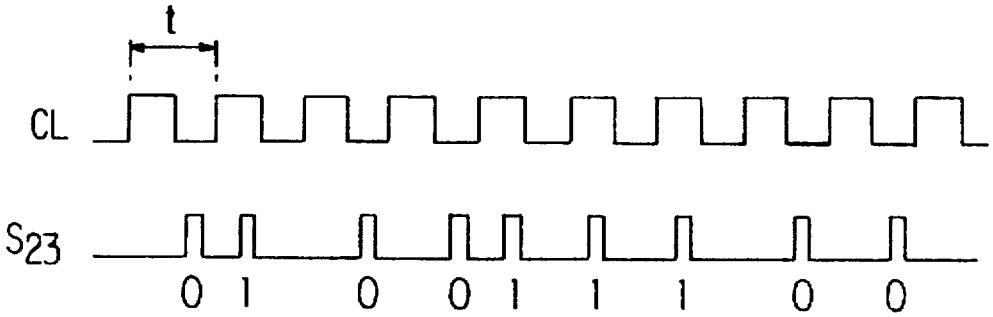
FIG. 14 is a signal waveform chart showing an example of signals of the power supplying oscillation section of the moving element in the patterning unit in the embodiment shown in the FIG. 13.

FIG. 14 shows each exemplary signal. The serial control signal S23 is output as a sequence consisting of 0 and 1 with respect to the control signal synchronizing signal CL. The signals CL and S23 are input to a positioning control microcomputer section 57. Receiving information necessary for positioning each moving element sent from the pattern controlling and moving element positioning control computer 23, the positioning control microcomputer section 57 develops an exciting signal S24 for the linear pulse motor and a current signal S25 to be output to the pulse motor driving circuit 58. Then, the pulse motor is positioned by means of an A-phase exciting signal S15 and a B-phase exciting signal S16.

FIG. 15 shows an embodiment of the serial control signal S23 transmitted by the control signal induction coil 52. While the method for transmitting and receiving the serial signal is known and its explanation is omitted here, the content of the signal will be explained below.

Control codes listed in the lower fields of FIG. 15 are control commands for the moving element and are common to all the moving elements.

The control commands can be roughly divided into two kinds of commands of transmitting control data and of starting the control. The control codes are explained below briefly.

05H Transmit command values: Transmit a movement for positioning, direction, and presence or absence of overlapping to each moving element from pattern data. Transmit once per turn.

01H Start underlap positioning: Execute command of transmitting command value. It is a synchronizing 02H Start overlap positioning: Execute command of transmitting command value. It is a synchronizing signal for starting.

06H Transmit return command value: Used primarily for recovering operation after occurrence of error. Command a movement to be returned.

03H Start positioning of return: Execute command in accordance to return command value.

04H Start adjustment of span: It is a command for starting to control excitation of pulse motor when the position of the stator of the pulse motor is to be adjusted with absolute position detected value. Present position of each moving element is updated.

07H Transmit correction value: Transmit correction value to each moving element. Positioning position is corrected by correcting zero offset values.

08H Transmit control data: Transmit control parameters.

0FH–51H Transmit positioning parameters: Transmit positioning control time with respect to move pulse and current value.

60H–62H Transmit present position of moving element: Transmit absolute detected value to update internal data of moving element.

Mounting the microcomputer in the moving element positioning control section as described above allows the positioning control section and the distributed processing to be realized and the problems to be solved, thus allowing to accommodate with the multi-function of the future, in view of its accommodation to the multiple pulses, to the position correcting function and cordless control and to the multiple moving elements.

Figure 16:
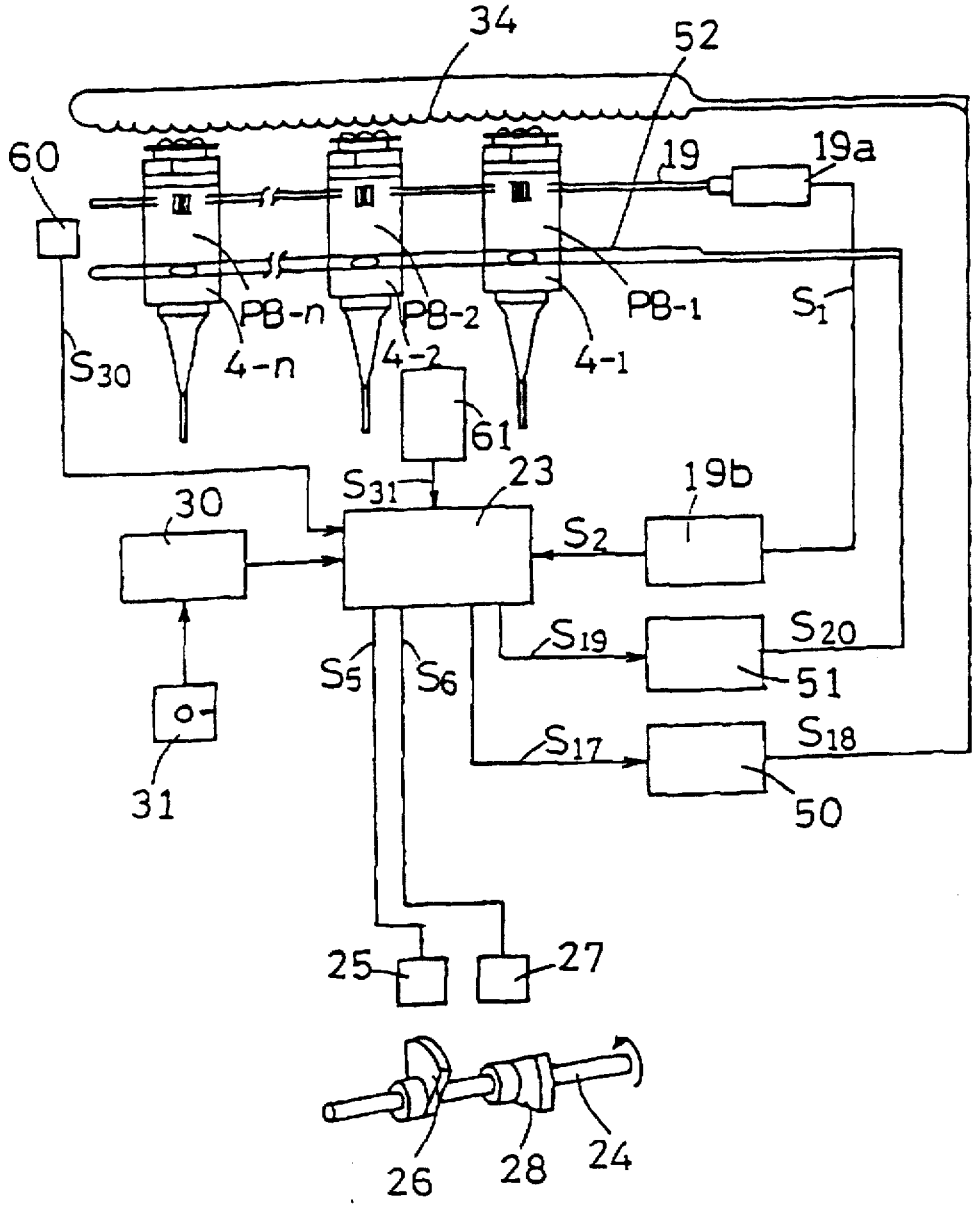
FIG. 16 is a block diagram showing one example of a control mechanism according to an embodiment in which two lines consisting of a power supplying induction coil and the control signal induction coil are applied.

FIG. 16 is a block diagram of a control mechanism of the embodiment in which two lines consisting of the power supplying induction coil 34 and the control signal induction coil 52 are provided.

As compared to one described before in FIG. 9, the oscillating section for exciting the induction coil 34 is divided into an oscillating section 51 for exciting the control signal induction coil and an oscillating section 50 for exciting the power supplying induction coil and a control signal S19 output from the moving element positioning control computer 23 is input to the oscillating section 51 to output an oscillating section output signal S20 to be supplied to the control signal induction coil 52. Similarly, a control signal S17 is input to the power supplying oscillating section 50 and an oscillating section output signal Sl8 which is output as ON and OFF signals is supplied to the power supplying induction coil 34.

Microcomputer positioning control substrates PB-1, PB-2, . . . PB-n are mounted on the moving elements 4-1, 4-2, . . . 4-detecting a temperature of the holding member portion on which the moving elements are mounted and a correction control panel 61 are provided to realize the optimum patterning and positioning control by inputting temperature data S30 and a correction control signal S31 to the moving element positioning control computer 23 to give commands of correction values for the correction of position necessary due to temperature changes and for the adjustment necessary for each individual moving element to the aforementioned moving element correction functions.

Figure 17:
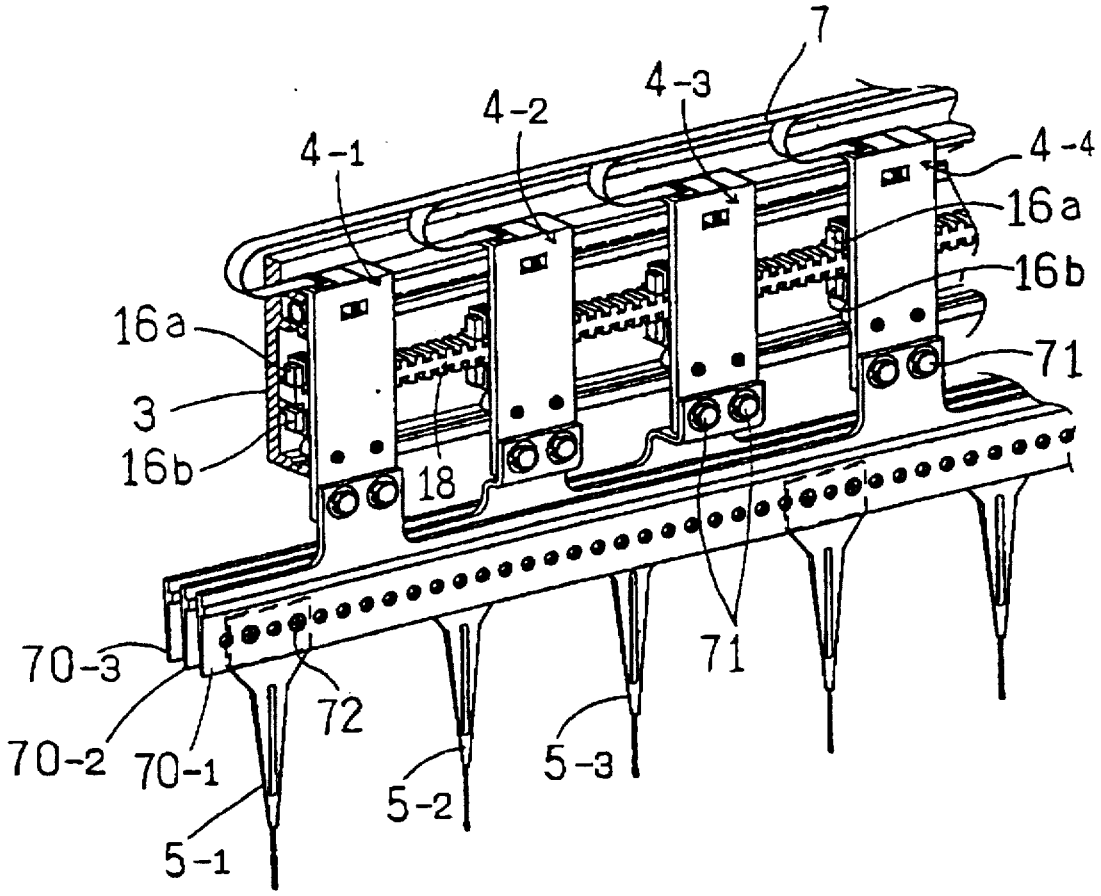
FIG. 17 is a partly cutaway perspective view of a part of the moving element showing an embodiment in which a moving element per holding member is constructed by attaching a guide bar.

FIG. 17 shows one example of a patterning unit constructed by attaching guide bars having a plurality of guide points to the moving elements moved and positioned as described above.

The basic structure of this embodiment is common with the embodiment shown in FIG. 3, so that the same components are designated with the sane reference characters and their detailed explanation is omitted here. The stator 18 of the linear pulse motor is assembled in the holding member 3 as a guide path and a plurality of moving elements 4 (4-1, 4-2, 4-2, 4-4, . . . ) are disposed on the same path so that poles 16*a* and 16*b* of each moving element face to the poles on both sides of the stator 18 provided in the holding member 3 as the guide path so as to be movable individually in the knitting width direction. Then, guide bars 70 (70-1, 70-2, 70-3, . . . ) to which a plurality of guide points 5 (5-1, 5-2, 5-3, . . .) are provided are attached to the arbitrary, plural number of moving elements 4 by screw clamp means 71. Each guide point 5 is attached to a desirable position of the guide bar 70 by screws 72.

The moving elements 4 hold the guide bar 70 at least at two points close edge thereof for each guide bar, though it depends on a length of the guide bar 70, i.e. the knitting machine width. The moving elements 4 for holding the guide bar 70 at several points may be provided at adequate intervals depending on the length of the guide bar 70.

When the plurality of guide bars 70 are provided so as to be movable respectively by the moving elements by shifting the attaching positions in the direction of the front and back of the knitting machine, the displacement of each guide bar 70 may be individually controlled readily and quickly. Further, because the plurality of guide bars may be provided individually displaceable within the same guide path, a space margin is created for installing the guide bars and a structure in which a number of guide bars are provided in parallel may be readily realized.

It is noted that although the linear pulse motor driving circuit of the control unit and the moving element driving coils are connected by the signal cables 7 in FIG. 17, it is possible to remove the signal cables like those in FIGS. 9 and 12 to control by way of wireless control also in this embodiment. In this case, it is necessary to provide a unit in which an induction coil, a power receiving coil and current circuit, a driving circuit and a signal detecting circuit are assembled on the upper part of the moving element 4. Further, the embodiment is possible to implement it by disposing the poles of the moving element so as to face to the poles on one side of the stator as one in FIG. 12.

Further, beside setting a number of pulses for moving one gage to one pulse, it may be set at a plurality of pulses also in this embodiment. It is also possible to mount a microcomputer on the moving element to position individually and to construct using two lines consisting of the power supplying induction line and the control signal induction line.

According to the inventive patterning unit of the warp knitting machine, a load placed on the moving element bearing is reduced and the thickness of the motor is reduced without reducing a thrust of the linear pulse motor, so that the number of the holding members, which corresponds to a thread guiding reed of the prior art machine, may be increased and the assemble thereof and adjustment, like an alignment with knitting needles, may be made readily.

Further, a leakage magnetic flux may be reduced and the thrust may be uniformed by arranging so that a magnetic path of the magnets runs in the same direction, so that guide points may be positioned stably.

Information for positioning the moving element is incorporated logically in the circuit as moving conditions of positioning control commands by the first control method of the inventive patterning unit, so that it becomes unnecessary to return to the reference position in restarting after power failure, step-out caused by various external noise sources is eliminated and no erroneous operation occurs. Further, it becomes possible to guarantee a short-time and reliable positioning by controlling the exciting position, exciting current and excitation switching timing by parameters given above.

Further, because the restriction on the moving range of the moving element is eliminated in creating a pattern by removing the signal cables connected with the moving elements and by positioning the moving elements by way of wireless control, pattern yarns may be run freely and fully in the knitting machine width, allowing knitting of lace fabrics having a new pattern structure which has been impossible in the past. Further, it allows the machine to be miniaturized its weight to be reduced and high thrust to be realized, thus contributing to the increase of the speed.

Further, the moving element nay be positioned without being restricted by an amount of information of the control signals and the load of the moving element positioning control computer may be reduced, putting the machine into more practical use, by mounting the microcomputer or the logic circuit on the moving element to reduce the control signals transmitted to the induction coil for the correction of the position and the like.

Thus, the patterning unit of the warp knitting machine and the control methods thereof of the present invention allow the problems (1) through (8) described above to be solved and readily enable the patterning and knitting carried out by controlling the move of the moving elements provided with the guide points by utilizing the linear pulse motor.

We claim:

1. A method for controlling a patterning unit of a warp knitting machine comprising:

providing a holding member having moving elements slidably mounted thereon to travel along a guide path;

providing a stator of a linear pulse motor on said holding member along said guide path;

providing each of said moving elements with drive coils for operating in conjunction with said stator to form said linear motor;

providing said moving elements with a guide member for guiding patterning yarn;

providing a signal transfer means along said guide path for transferring signals to said moving elements to effect operation of said linear pulse motor;

providing a signal reception means, on each of said moving elements, for slidably interfacing with said signal transfer means and receiving said signals and driver means for driving said drive coils of said linear pulse motor in response to said signals; and positioning said moving elements by supplying power and control signals, via said signals received by said signal reception means, to the moving elements for operating said linear pulse motors of said moving elements.

2. A method of controlling a patterning unit of a warp knitting machine according to claim 1, wherein providing said driver means includes mounting one of a microcomputer and a logic circuit on each of said moving elements which is responsive to control codes transmitted via said signals received by said signal reception means to reduce an amount of control signals transmitted to the moving elements for positioning.

3. The method of claim 1, wherein:

said providing a signal transfer means includes providing an induction coil mounted along said guide path; and said providing a signal reception means includes providing a receiving coil on each of said moving elements for contactlessly interfacing with said induction coil to receive said signals from said induction coil.

4. The method according to claim 3, wherein providing said driver means includes mounting one of a microcomputer and a logic circuit on each of said moving elements which is responsive to control codes transmitted via said signals received by said receiving coil to reduce an amount of control signals transmitted to the moving elements for positioning.

5. The method according to claim 1 wherein:

said providing a signal transfer means includes providing a contact rail along said guide path; and said providing a signal reception means includes providing a slip ring contact on each of said moving elements for slidably contacting said contact rail.

6. The method according to claim 5, wherein providing said driver means includes mounting one of a microcomputer and a logic circuit on each of said moving elements which is responsive to control codes transmitted via said signals received by said slip ring contact to reduce an amount of control signals transmitted to the moving elements for positioning.

7. The method according to claim 1, wherein said providing said moving elements with a guide member for guiding patterning yarn includes providing said moving elements each with a guide point for guiding patterning yarn.

8. The method according to claim 1, wherein said providing said moving elements with a guide member for guiding patterning yarn includes providing said moving elements with a guide bar for guiding patterning yarn.

9. A warp knitting machine comprising:

a control means for controlling operation of said knitting machine;

a needle row;

a guide rail disposed above said needle and defining a guide path;

moving elements slidably disposed on said guide rail and having guide means for guiding patterning yarn for effecting lapping in conjunction with said needle row;

said guide rail having a stator member disposed along said guide path;

said moving elements each having a drive coil for operating in conjunction with said stator to form a linear motor;

a signal transfer means for transferring signal from said guide rail to said moving elements, said signal transfer means including a signal transmission means mounted along said guide path of said guide rail and signal reception means mounted on said moving elements for slidably interfacing with said signal transmission means to receive power and control signals from said signal transmission means;

said control means including a memory for storing knitting pattern data and a control signal generation means for generating said power and control signals in accordance with said knitting pattern data and applying said power and control signals to said signal transmission means; and said moving elements including driver means for driving said drive coils in accordance with said control signals to selectively guide a patterning yarn guided by respective guide means of respective ones of said moving elements.

10. The warp knitting machine according to claim 9 wherein:

said signal transmission means includes an elongated induction coil mounted along said guide path; and said signal reception means includes a receiving coil mounted on each of said moving elements for contactlessly interfacing with said elongated induction coil to receive said power and said control signals from said induction coil.

11. The warp knitting machine according to claim 9 wherein:

said control signal generation means includes a power signal generator for providing a power signal which is inductively coupled to said moving elements via said signal transfer means and a modulator for modulating said power signal in accordance with said knitting pattern data to produce said control signals; and said driver means include a power rectifying circuit for providing power for said drive coils, a demodulating means for recovering said control signals and a driver circuit for applying said power to said drive coils in accordance with said control signals.

12. The warp knitting machine according to claim 11 wherein said driver circuit includes a microcomputer responsive to control codes included in said control signals to effect control of said drive coils to individually position said moving elements.

13. The warp knitting machine according to claim 11 wherein said modulator effects pulse width modulation of said power signal in accordance with said control signals.

14. The warp knitting machine according to claim 9 wherein:

said signal transmission means includes an first elongated induction coil mounted along said guide path for transmitting said power and a second elongated induction coil mounted along said guide path for transmitting said control signals;

said signal reception means includes a first receiving coil mounted on each of said moving elements for contactlessly interfacing with said first elongated induction coil to receive said power; and said signal reception means includes a second receiving coil mounted on each of said moving elements for contactlessly interfacing with said second elongated induction coil to receive said control signals.

15. The warp knitting machine according to claim 14 wherein:

said control signal generation means includes a power signal generator for providing a power signal which is inductively coupled to said moving elements via said signal transfer means; and said driver means include a power rectifying circuit for providing power for said drive coils and a driver circuit for applying said power to said drive coils in accordance with said control signals.

16. The warp knitting machine according to claim 15 wherein said driver circuit includes a microcomputer responsive to control codes included in said control signals to effect control of said drive coils to individually position said moving elements.

* * * * *